US008376181B2

(12) United States Patent
Lundgreen et al.

(10) Patent No.: US 8,376,181 B2
(45) Date of Patent: Feb. 19, 2013

(54) CONTAINER ASSEMBLY WITH FLEXIBLE LID SEAL AND RELEASING ARRANGEMENT

(75) Inventors: Ken Lundgreen, Algonquin, IL (US); Steve Grider, West Dundee, IL (US); Arif Sitabkhan, Chicago, IL (US); John Gephart, Corning, NY (US); Paul Katz, New York, NY (US); Tara Marchiona, New York, NY (US); Kirsten Climer, Brooklyn, NY (US); Davin Stowell, New York, NY (US)

(73) Assignee: WKI Holding Company, Inc., Rosemont, IL (US)

( * ) Notice: Subject to any disclaimer, the term of this patent is extended or adjusted under 35 U.S.C. 154(b) by 258 days.

(21) Appl. No.: 12/785,109

(22) Filed: May 21, 2010

(65) Prior Publication Data

US 2011/0284545 A1 Nov. 24, 2011

(51) Int. Cl.
*B65D 43/00* (2006.01)
*B65D 51/00* (2006.01)
*B65D 53/00* (2006.01)

(52) U.S. Cl. ..... 220/805; 220/801; 220/804; 220/377; 220/378; 220/254.3

(58) Field of Classification Search ..... 220/801, 220/805, 231, 377, 378, 254.3, 804, 806, 220/254.1; 215/262, 364, 305, 295; 53/471; 277/644, 637, 328
See application file for complete search history.

(56) References Cited

U.S. PATENT DOCUMENTS

| | | | | |
|---|---|---|---|---|
| 1,369,969 | A | 3/1921 | Fairbanks et al. | |
| 2,047,720 | A | 7/1936 | Wilhelm | |
| 2,075,477 | A * | 3/1937 | Smith | 228/124.1 |
| 2,234,485 | A | 3/1941 | Connor | |
| 3,273,743 | A | 9/1966 | McColl | |
| 3,688,942 | A | 9/1972 | Mitchell et al. | |
| 4,078,696 | A | 3/1978 | Crisci | |
| 4,466,552 | A | 8/1984 | Butterworth et al. | |
| D282,616 | S | 2/1986 | Gallagher et al. | |
| 5,065,885 | A | 11/1991 | Scaroni | |
| 5,337,913 | A | 8/1994 | Fukuda | |
| 5,405,038 | A | 4/1995 | Chuang | |
| 5,427,266 | A | 6/1995 | Yun | |

(Continued)

FOREIGN PATENT DOCUMENTS

| | | | |
|---|---|---|---|
| EP | 0112295 | A2 | 12/1983 |
| JP | 11263358 | A * | 9/1999 |

(Continued)

*Primary Examiner* — Robin Hylton
(74) *Attorney, Agent, or Firm* — McDermott Will & Emery LLP

(57) ABSTRACT

A storage container assembly comprises a storage receptacle and a removable lid. The storage receptacle has a base and a continuous sidewall connected to the base. The sidewall projects upward from the base to a peripheral edge. The removable lid has a rigid central cover portion and a flexible seal portion that traverses a perimeter of the rigid central portion. The flexible seal portion has a release tab disposed along its periphery, and a pocket disposed inward of the release tab. The flexible seal portion further has a ledge disposed generally at the periphery of the flexible seal portion. The ledge contacts the peripheral edge of the storage receptacle. The flexible seal portion further has and a blade portion disposed below the ledge. The blade portion contacts the side wall of the storage receptacle and forms a generally fluid-tight seal with the sidewall.

26 Claims, 3 Drawing Sheets

U.S. PATENT DOCUMENTS 5,641,065 A 6/1997 Owens et al.
5,688,544 A 11/1997 Bolton et al.
5,785,201 A 7/1998 Bordner et al.
5,893,477 A 4/1999 Kaneko et al.
5,921,432 A 7/1999 Van Berne et al.
5,944,211 A 8/1999 Woodnorth et al.
D415,652 S 10/1999 Loew et al.
5,974,686 A 11/1999 Nomura et al.
D417,817 S 12/1999 Loew et al.
6,035,769 A 3/2000 Nomura et al.
6,116,151 A 9/2000 Fickert et al.
D431,419 S 10/2000 Greene
D440,470 S 4/2001 Tucker et al.
D443,184 S 6/2001 Maxwell et al.
D443,798 S 6/2001 Tucker et al.
D445,641 S 7/2001 Conti
D445,649 S 7/2001 Maxwell et al.
D445,687 S 7/2001 Gilbertson
D446,117 S 8/2001 Conti
D448,606 S 10/2001 Conti
D448,969 S 10/2001 Conti
D450,537 S 11/2001 Hayes
D452,374 S 12/2001 Kim
D455,321 S 4/2002 Jung et al.
6,364,152 B1 4/2002 Poslinski et al.
6,415,945 B1 7/2002 Zank et al.
6,415,947 B1 7/2002 Kim
D461,678 S 8/2002 Hayes
6,494,338 B1 12/2002 Schultz
6,557,720 B2 5/2003 Tosdale et al.
6,568,534 B2 5/2003 Zank
D475,573 S 6/2003 Jalet et al.
6,581,939 B1 6/2003 Theros et al.
D478,469 S 8/2003 Roth et al.
D481,910 S 11/2003 Kim
D483,622 S 12/2003 Kim
D484,367 S 12/2003 Kim
6,685,046 B2 2/2004 Ogino
6,698,336 B1 3/2004 Siegel et al.
D488,031 S 4/2004 Kim
D490,277 S 5/2004 Kim
D493,073 S 7/2004 Kim
D496,560 S 9/2004 Lerner
6,793,096 B1 9/2004 Seok
D498,389 S 11/2004 Tollman
D499,931 S 12/2004 Kim
D500,227 S 12/2004 Seok
D501,764 S 2/2005 Lerner
6,877,633 B2 4/2005 Niese
D505,840 S 6/2005 Schultz et al.
D507,155 S 7/2005 Gosen et al.
D508,825 S 8/2005 Kim
D512,278 S 12/2005 Schultz et al.
D514,811 S 2/2006 Koo
D514,954 S 2/2006 Kim
D516,376 S 3/2006 Kim
D517,311 S 3/2006 Kim
D521,812 S 5/2006 Kim
D523,296 S 6/2006 Kim
D524,119 S 7/2006 Kim
D525,489 S 7/2006 Kim
7,077,282 B2 7/2006 Tondar et al.
7,086,326 B2 8/2006 Yokoyama
7,090,089 B2 8/2006 Lown et al.
7,097,067 B2 8/2006 Scarabelli et al.
D528,357 S 9/2006 Hsu
7,114,617 B2 10/2006 Yewdall et al.
D536,571 S 2/2007 Kim
D537,300 S 2/2007 Kim
D539,098 S 3/2007 Tucker et al.
D549,519 S 8/2007 Moon et al.
D553,444 S 10/2007 deGroote et al.
7,299,941 B2 11/2007 McMahon, III et al.
D562,083 S 2/2008 Lown et al.
D566,483 S 4/2008 Tucker et al.
D575,115 S 8/2008 Zimmerman
7,413,099 B2 8/2008 Takahashi et al.
D586,179 S 2/2009 Furlong
D606,813 S 12/2009 Kim
D610,878 S 3/2010 Kim
D610,879 S 3/2010 Kim
D612,196 S 3/2010 Furlong
D615,821 S 5/2010 Stamper
D618,516 S 6/2010 DiPietro et al.
7,753,223 B2 7/2010 Boozer et al.
2003/0019878 A1 1/2003 Scarabelli et al.
2003/0116572 A1 6/2003 Klock et al.
2003/0160056 A1 8/2003 Moon et al.
2003/0178428 A1 9/2003 Chang
2003/0209864 A1* 11/2003 Dron ..... 277/628
2005/0006390 A1 1/2005 Wang
2005/0205577 A1 9/2005 Park
2007/0095849 A1 5/2007 Kim
2007/0170190 A1 7/2007 Milesi et al.
2008/0041852 A1 2/2008 Cai
2008/0083752 A1 4/2008 Mantyla et al.
2008/0203092 A1* 8/2008 Stamper et al. ..... 220/203.01
2010/0089934 A1 4/2010 Lim

FOREIGN PATENT DOCUMENTS

JP 2004307059 A 11/2004
JP 2005193980 A 7/2005
KR 2005042421 A 5/2005
KR 661905 B1 12/2006
KR 2007099735 A 10/2007
KR 439997 Y1 5/2008
KR 2008043932 A 5/2008
KR 2009034619 A 4/2009
KR 2009012679 U 12/2009

* cited by examiner

FIG. 1
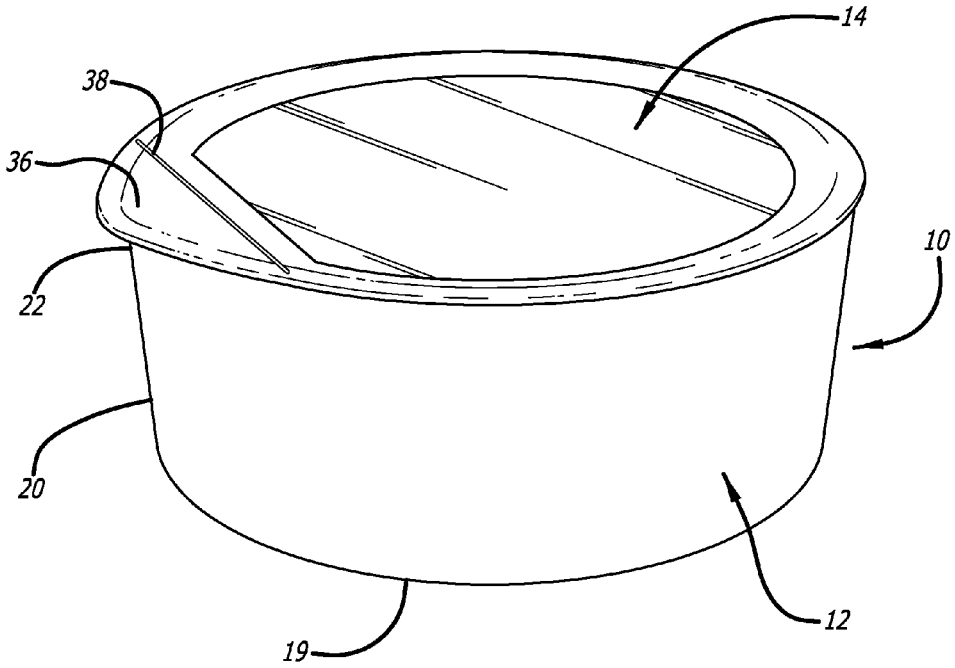
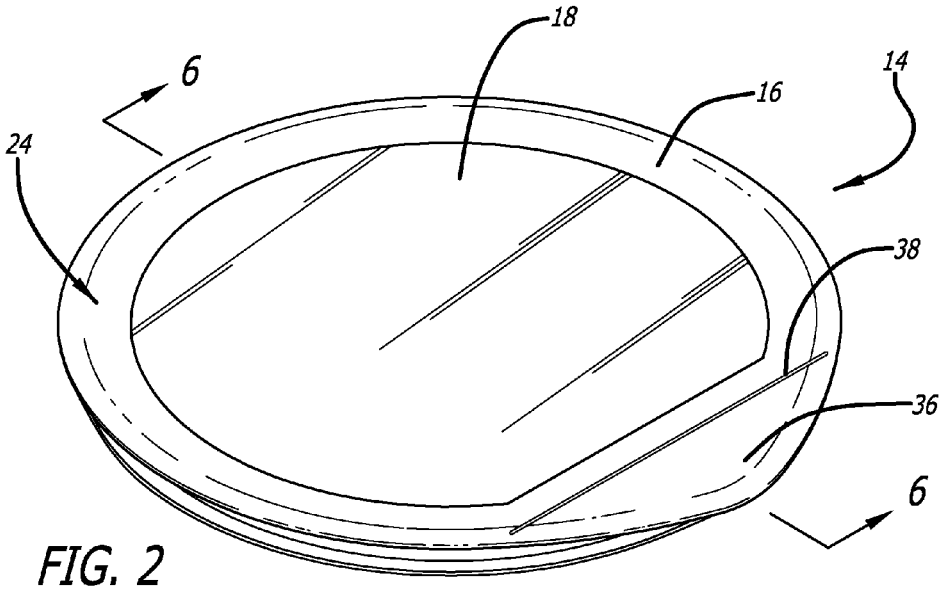
FIG. 2

CONTAINER ASSEMBLY WITH FLEXIBLE LID SEAL AND RELEASING ARRANGEMENT

TECHNICAL FIELD

The present invention relates to a container assembly, and more particularly, to a container assembly with a flexible seal.

BACKGROUND OF THE INVENTION

When storing leftover food, or food that is to be prepared at a later time, it is common to utilize a container assembly that comprises a storage vessel and a lid that is removably securable to the storage vessel. These types of container assemblies have existed for a long period of time, however, often times a generally fluid tight seal is not properly formed between the storage vessel and the lid of the container assembly. A proper generally fluid tight seal may not be formed for a variety of reasons, ranging from slight manufacturing defects, such as slight surface defects, to the limitations in manufacturing products to exact specifications. Additionally prior seals may be difficult to install within the lid, or may not form a proper seal if a portion of the storage vessel that the seal contacts has any food material present.

Thus, it would be useful to provide a container assembly having a removable lid with an improved generally fluid tight seal. Therefore, a need exists for a storage assembly with an improved generally fluid tight seal.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to one embodiment, a storage container assembly that has a generally fluid-tight seal comprises a storage receptacle and a removable lid. The storage receptacle has a base and a continuous sidewall connected to the base. The sidewall projects upward from the base and terminates at a peripheral edge. The removable lid has a rigid central cover portion and a flexible seal portion that traverses a perimeter of the rigid central portion. The flexible seal portion has a release tab disposed along a periphery of the flexible seal portion, and a pocket disposed inward of the release tab. The flexible seal portion further has a ledge disposed generally at the periphery of the flexible seal portion. The ledge contacts the peripheral edge of the storage receptacle. The flexible seal portion further has and a blade portion disposed below the ledge that has a thickness. The blade portion contacts the side wall of the storage receptacle and forms a generally fluid-tight seal with the sidewall.

According to one process, a method of forming a container assembly having a generally fluid tight seal is provided. A storage receptacle having a base and a continuous sidewall is provided. A removable lid has a flexible seal portion and a rigid central cover portion is also provided. The flexible seal portion traverses a perimeter of the rigid cover portion. The flexible seal portion has a ledge and a blade portion. The flexible seal portion additionally has a release tab that projects from the flexible seal portion. The removable lid is aligned with the storage receptacle. The removable lid is secured to the storage receptacle such that the ledge of the flexible seal portion contacts a top of the continuous sidewall of the storage receptacle. The blade portion of the flexible seal contacts, and is displaced by, the continuous sidewall of the storage receptacle to affix the lid to the storage receptacle.

According to another embodiment, a removable lid with a generally fluid tight seal for use with a storage receptacle that has a base and a continuous sidewall connected to the base is provided. The lid comprises a rigid cover portion and a flexible seal portion. The flexible seal portion has a release tab disposed along a periphery of the flexible seal portion and a pocket disposed inward of the release tab. The flexible seal portion further has a ledge disposed generally at the periphery of the flexible seal portion. The ledge contacts a peripheral edge of a storage receptacle. The flexible seal portion further has and a blade portion disposed below the ledge that has a thickness. The blade portion is moveable from a first generally horizontal orientation to a second generally vertical orientation to form a seal on the sidewall of the storage receptacle.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 1 is a pictorial view of a container assembly according to one embodiment;

FIG. 2 is a pictorial view of a lid for a container assembly according to one embodiment;

Figure 3:
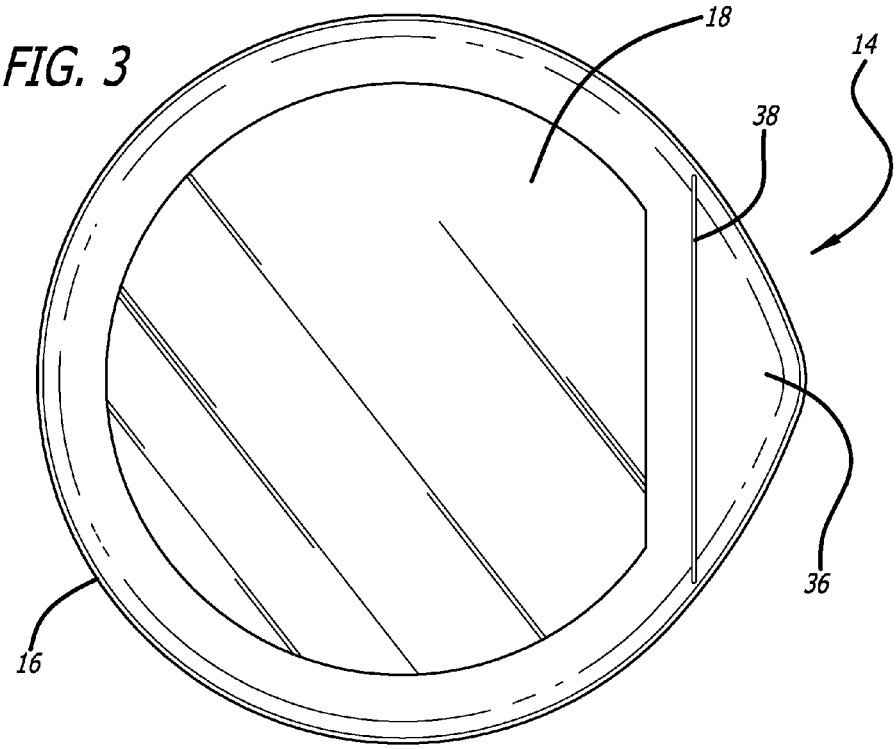
FIG. 3 is top view of the lid of FIG. 2.
Figure 4:
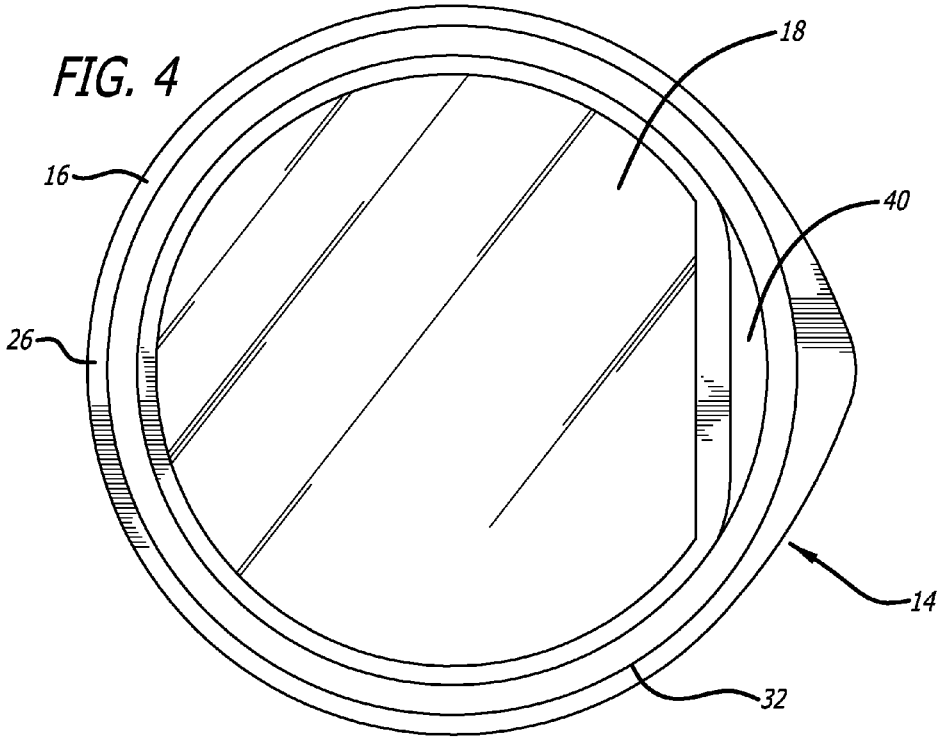
FIG. 4 is a bottom view of the lid of FIG. 2.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

According to one embodiment of the present invention, as shown in FIG. 1, a container assembly 10 is provided. As will be discussed below, according to one aspect of the invention, the container assembly 10 comprises a storage vessel 12, a lid portion 14. The storage vessel 12 comprises a base portion 19 and a continuous sidewall 20 projecting upward from the base portion 19. The sidewall 20 begins at the base portion 19 and terminates at an upper peripheral edge 22. It is contemplated that the base portion 19 of the storage vessel 12 may be provided in a variety of shapes, such as circular, as shown in FIG. 1, a square, a triangle, an oval, a rectangle, or any other shape into which a container may be configured. It is further contemplated that the edge 22 of the sidewall 20 will generally be rounded. Providing a rounded edge 22 reduces the wear on a flexible seal portion 16 (FIG. 2) of the lid portion 14 and also decreases the likelihood of a user being cut by the storage vessel 12. A rounded edge 22 may also increase the strength of the edge 22 by providing a greater amount of material in that location, thus reducing the likelihood of breaking the storage vessel 12.

As shown in FIGS. 2-6, the lid portion 14 has a flexible seal portion 16 and a rigid central over portion 18. The rigid central cover portion, or rigid cover portion, 18 is disposed within the flexible seal portion 16. The rigid cover portion 18 is constructed from a substantially rigid material, such as glass. It is contemplated that the rigid cover portion 18 may be constructed from other materials, such as polymeric materials, acrylic, metals, or the like. It is also contemplated that the rigid cover portion 18 be transparent. The use of a transparent rigid cover portion 18 allows the contents of the container assembly 10 to be readily determined.

Figure 6:
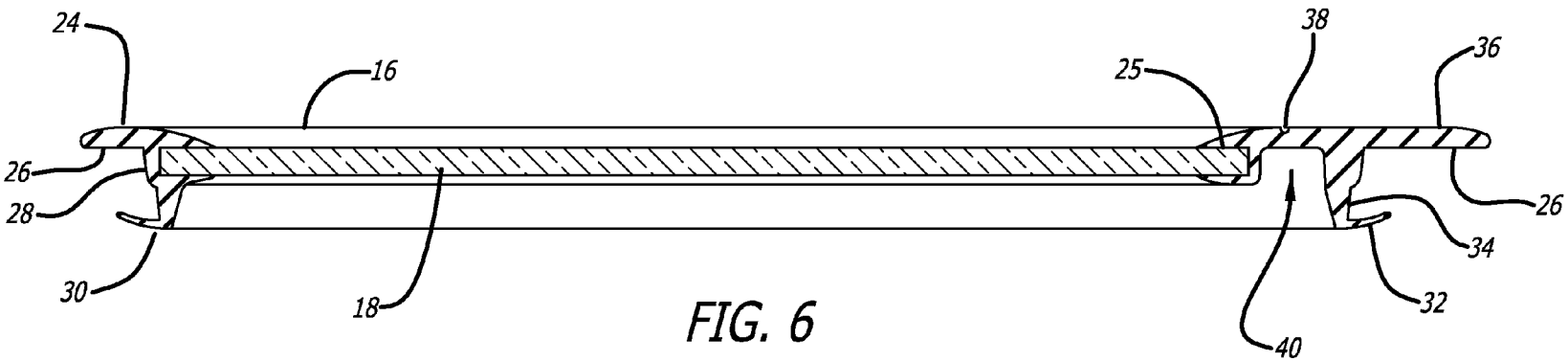
FIG. 6 is a sectional view of the lid of FIG. 2 taken along line 6-6 of FIG. 2.

The flexible seal portion 16 comprises an upper portion 24. The upper portion 24 surrounds a periphery of the rigid cover portion 18. As shown in FIG. 6, the upper portion 24 has a groove 25 that traverses the perimeter of the rigid cover portion 18 to contain the cover portion within the flexible seal 16 of the lid 14. The upper portion 24 additionally forms a ledge 26 that is adapted to rest upon the edge 22 of the side wall 20 of the storage vessel 12. It is contemplated that dimensions of the ledge 26 of the lid portion 14 are greater than dimensions of the edge 22 of the storage vessel 12. For instance, as shown in FIG. 1, the diameter of the ledge 26 is greater than the diameter of the edge 22 of the storage vessel 12, such that at least a portion of the ledge 26 extends beyond the edge 22. The upper portion 24 further has a first generally vertical sidewall 28. The first generally vertical sidewall 28 is adapted to contact an inner portion of the sidewall 20 of the storage vessel 12. The first generally vertical sidewall 28 and the ledge 26 are thus both adapted to contact the storage vessel 12.

Figure 5:
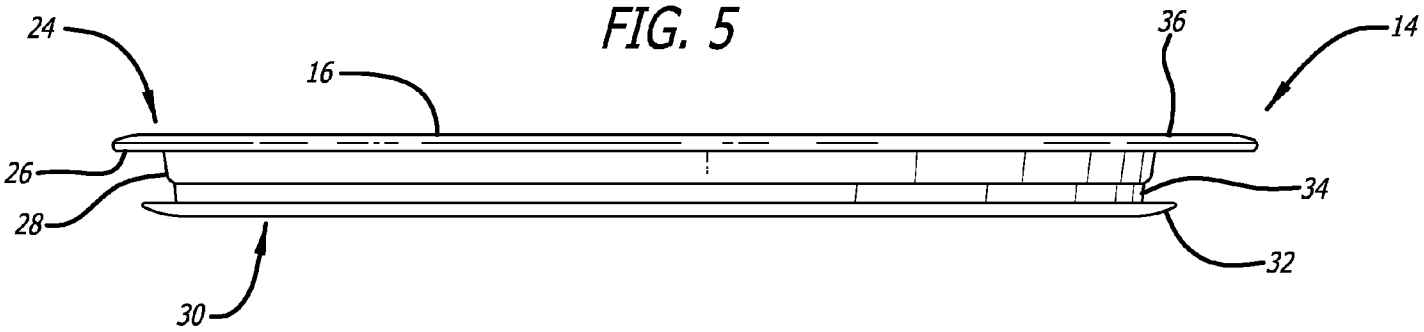
FIG. 5 is side view of the lid of FIG. 2.

The flexible seal portion 16 additionally has a lower portion 30. The lower portion 30 has a blade portion 32 and a second generally vertical sidewall 34. The blade portion 32, as shown in FIGS. 5 and 6, is biased to a generally horizontal orientation when the lid portion 14 is not utilized with the storage vessel 12. The blade portion 32 is displaceable to a generally vertical orientation when the lid portion 14 is engaged with the storage vessel 12. Additionally, as best observed in FIG. 6, the second generally vertical sidewall 34 is recessed, i.e., has a smaller outer diameter, a distance from the first generally vertical sidewall 28. The distance of the recess is such that when the blade portion 32 is in the generally vertical orientation, the blade portion 32 is generally co-planar with the first generally vertical sidewall 28. In this way, the entire length of the first generally vertical sidewall 28 and the blade portion 32 contact the wall 20 of the storage vessel 12 to form a seal to prevent the contents of the storage vessel 12 from spilling.

The lid portion 14 additionally comprises a release tab 36. The release tab 36 allows the flexible seal portion 16 to be displaced such that any vacuum formed between the lid portion 14 and the storage vessel 12 may be relieved so that the lid portion 14 may be removed from the storage vessel 12. The release tab 36 has a score line 38 formed in the top portion 24 of the release tab 36. The score line 38 projects downwardly from a top surface of the flexible seal portion. The score line 38 provides a pivot location where the release tab 36 bends relative to the rest of the flexible seal portion 16 of the lid portion 14. The release tab 36 further comprises a pocket 40 formed in the lower portion 30 of the flexible seal portion 16. The pocket 40 is outside of rigid cover portion 18 of the lid portion 14. The pocket 40 is disposed generally below the score line 38. Thus, the score line 38 and the pocket 40 cooperate to allow the flexible seal portion 16 to deform sufficiently when a generally upward force is applied to the release tab 36 so that the blade portion 32 adjacent the pocket 40 may lose contact with the container 12. Thus, any vacuum formed between the lid portion 14 and the storage vessel 12 is released, and the lid portion 14 may be easily removed.

It is contemplated that the flexible seal portion 16 may be injection molded silicone, a thermoplastic vulcanizate (TPV), a thermoplastic rubber (TPR), or a thermoplastic elastomer (TPE).

Thus, to form the container assembly 10, the lid portion 14 is provided above the storage vessel 12. The lid portion 14 contacts the storage vessel 12 such that the blade portion 26 of the flexible seal portion 16 contacts the side wall 20 of the storage vessel 12 deflects upwards as the lid portion 14 is pressed against the storage vessel 12. A vertical force may be applied to the release tab 36 in order to release any excess air from the storage vessel 12 as the lid portion 14 is lowered, allowing the ledge 26 of the lid portion 14 to rest on the edge 22 of the storage vessel 12. The rigid cover portion 18 provides sufficient strength to the lid portion 14 that the flexible seal portion 16 is maintained relative to the side wall 20 of the storage vessel 12 and the contents of the container assembly 10 are restricted from leaking out.

While specific embodiments have been illustrated and described, numerous modifications come to mind without significantly departing from the spirit of the invention, and the scope of protection is only limited by the scope of the accompanying Claims.

What is claimed is:

1. A storage container assembly having a generally fluid tight seal, the assembly comprising:

a storage receptacle having a base and a sidewall connected to the base, the sidewall projecting upward from the base and terminating at a peripheral edge; and a removable lid having a rigid central cover portion having an outer edge defining a perimeter of the rigid central cover portion and a flexible seal portion traversing the perimeter of the rigid central cover portion, the flexible seal portion having a release tab disposed along at least a portion of a periphery of the flexible seal portion and a pocket disposed inward of the release tab, the flexible seal portion further having a ledge disposed generally at the periphery of the flexible seal portion, the ledge contacting the peripheral edge of the storage receptacle, the flexible seal portion further having a blade portion disposed below the ledge and extending in a outward direction away from the rigid central cover portion, the blade portion contacting the sidewall of the storage receptacle and forming a generally fluid-tight seal with the sidewall.

2. The storage container assembly of claim 1, wherein the flexible seal portion has a top portion and a lower portion, the top portion including a first generally vertical sidewall and the ledge, the lower portion including a second generally vertical sidewall and the blade portion.

3. The storage container assembly of claim 2, wherein the second generally vertical sidewall is recessed a distance from the first generally vertical sidewall.

4. The storage container assembly of claim 3, wherein the distance the second generally vertical sidewall is recessed from the first generally vertical sidewall is approximately the same as a thickness of the blade portion.

5. The storage container assembly of claim 2, wherein the top portion further includes a score line, the score line disposed in a top surface of the flexible seal portion and disposed above the pocket.

6. The storage container assembly of claim 1, wherein the flexible seal portion has a groove, the groove traversing a perimeter of the rigid cover portion.

7. The storage container assembly of claim 1, wherein the rigid cover portion is transparent.

8. The storage container assembly of claim 1, wherein the rigid cover portion is transparent glass.

9. The storage container assembly of claim 1, wherein the flexible seal portion comprises silicone.

10. A method of forming a container assembly having a generally fluid tight seal, the method comprising:

providing a storage receptacle having a base and a sidewall;

providing a removable lid having a flexible seal portion traversing a perimeter of a rigid central cover portion, the flexible seal portion having a ledge and a blade portion extending away from the rigid central cover portion, the flexible seal portion additionally having a release tab projecting from the flexible seal portion and a pocket disposed inward of the release tab;

aligning the removable lid with the storage receptacle; and securing the removable lid to the storage receptacle such that the ledge of the flexible seal portion contacts a top of the sidewall of the storage receptacle, the pocket is located inward of the sidewall, and the blade portion of the flexible seal contacting and being displaced by the sidewall of the storage receptacle to affix the lid to the storage receptacle.

11. The method of claim 10, wherein when the sidewall displaces the blade portion of the seal the blade portion is moved to a generally vertical orientation.

12. The method of claim 10 further comprising deflecting the release tab to allow air to escape from the storage receptacle to move the ledge of the flexible seal into contact with the top of the sidewall.

13. A removable lid with a generally fluid tight seal for use with a storage receptacle, the lid comprising:

a rigid cover portion having an outer edge defining a perimeter; and a flexible seal portion traversing the perimeter of the rigid central cover portion, the flexible seal portion having a release tab disposed along a periphery of the flexible seal portion and a pocket disposed inward of the release tab, the flexible seal portion further having a ledge disposed generally at the periphery of the flexible seal portion, the flexible seal portion further having a blade portion disposed below the ledge and extending away from the rigid cover portion, the blade portion being moveable from a first generally horizontal orientation to a second generally vertical orientation when the lid is engaged with the storage receptacle.

14. The removable lid of claim 13, wherein the flexible seal portion has a top portion and a lower portion, the top portion having a first generally vertical sidewall and the ledge, the lower portion having a second generally vertical sidewall and the blade portion.

15. The removable lid of claim 14, wherein the second generally vertical sidewall is recessed a distance from the first generally vertical sidewall.

16. The removable lid of claim 15, wherein the distance the second generally vertical sidewall is recessed from the first generally vertical sidewall is approximately the same as a thickness of the blade portion.

17. The removable lid of claim 13, wherein the top portion additionally has a score line formed in a top surface of the flexible seal portion and disposed above the pocket.

18. The removable lid of claim 13, wherein the flexible seal portion has a groove, the groove traversing a perimeter of the rigid cover portion.

19. The removable lid of claim 13, wherein the rigid cover portion is transparent glass.

20. The removable lid of claim 13, wherein the flexible seal portion comprises silicone.

21. A storage container assembly having a generally fluid tight seal, the assembly comprising:

a storage receptacle having a base and a sidewall connected to the base, the sidewall projecting upward from the base and terminating at a peripheral edge; and a removable lid having a rigid central cover portion having an outer edge defining a perimeter of the rigid central cover portion and a flexible seal portion extending along the perimeter of the rigid central cover portion, the flexible seal portion having a release tab disposed along at least a portion of a periphery of the flexible seal portion and a pocket disposed inward of the release tab, the flexible seal portion further having a ledge disposed generally at the periphery of the flexible seal portion, the ledge contacting the peripheral edge of the storage receptacle, the flexible seal portion further having a blade portion disposed below the ledge, the blade portion contacting the sidewall of the storage receptacle and forming a generally fluid-tight seal with the sidewall, wherein the flexible seal portion has a top portion and a lower portion, wherein the top portion includes a first generally vertical sidewall, the ledge, and a score line, the score line disposed on a top surface of the flexible seal portion and disposed above the pocket, and wherein the lower portion includes a second generally vertical sidewall and the blade portion.

22. The storage container assembly of claim 21, wherein the second generally vertical sidewall is recessed a distance from the first generally vertical sidewall.

23. The storage container assembly of claim 22, wherein the distance the second generally vertical sidewall is recessed from the first generally vertical sidewall is approximately the same as a thickness of the blade portion.

24. A removable lid with a generally fluid tight seal for use with a storage receptacle, the lid comprising:

a rigid cover portion having an outer edge defining a perimeter; and a flexible seal portion traversing the perimeter of the rigid central cover portion, the flexible seal portion having a release tab disposed along a periphery of the flexible seal portion and a pocket disposed inward of the release tab, the flexible seal portion further having a ledge disposed generally at the periphery of the flexible seal portion, the flexible seal portion further having a blade portion disposed below the ledge, the blade portion being moveable from a first generally horizontal orientation to a second generally vertical orientation when the lid is engaged with the storage receptacle, wherein the flexible seal portion has a top portion and a lower portion, the top portion having a first generally vertical sidewall, the ledge, and a score line formed on a top surface of the flexible seal portion and disposed above the pocket, and wherein the lower portion has a second generally vertical sidewall and the blade portion.

25. The removable lid of claim 24, wherein the second generally vertical sidewall is recessed a distance from the first generally vertical sidewall.

26. The removable lid of claim 25, wherein the distance the second generally vertical sidewall is recessed from the first generally vertical sidewall is approximately the same as a thickness of the blade portion.

* * * * *